US010750811B1

(12) United States Patent
Langlois et al.

(10) Patent No.: US 10,750,811 B1
(45) Date of Patent: Aug. 25, 2020

(54) HELMET WITH SWEAT GUTTER

(71) Applicant: SPORT MASKA INC., Montreal (CA)

(72) Inventors: Simon Langlois, Notre-Dame-de-I'lle-Perrot (CA); Philippe Martin, Chambly (CA); Pierre-Luc Beauchamp, Montreal (CA); Brian Steenbrink, Pointe-Claire (CA)

(73) Assignee: SPORT MASKA INC., Montreal, Quebec (CA)

( * ) Notice: Subject to any disclaimer, the term of this patent is extended or adjusted under 35 U.S.C. 154(b) by 0 days.

(21) Appl. No.: 16/275,766

(22) Filed: Feb. 14, 2019

(51) Int. Cl.
*A42B 3/04* (2006.01)

(52) U.S. Cl.
CPC ..... *A42B 3/04* (2013.01)

(58) Field of Classification Search
CPC .... A42B 3/04; A42B 3/28; A42B 3/32; A42B 3/0493; A42B 3/10; A42C 5/02
See application file for complete search history.

(56) References Cited

U.S. PATENT DOCUMENTS

| | | | | |
|---|---|---|---|---|
| 1,359,502 | A | 11/1920 | Hahlo | |
| 1,434,854 | A | 11/1922 | Walter | |
| 2,320,782 | A * | 6/1943 | Larsen | A41D 20/00 2/171 |
| 2,706,456 | A | 4/1955 | Anne | |
| 2,728,083 | A | 12/1955 | Birch | |
| 2,822,546 | A | 2/1958 | Barker | |
| 3,089,146 | A | 5/1963 | Sterne | |
| 3,465,366 | A | 9/1969 | Topiel et al. | |
| 3,466,664 | A | 9/1969 | Militello | |
| 3,685,055 | A | 8/1972 | Militello | |
| 3,711,864 | A | 1/1973 | Dickstein | |
| 4,481,681 | A | 11/1984 | Hankin | |
| 4,626,247 | A | 12/1986 | Frankel | |
| 4,630,317 | A | 12/1986 | Brown | |
| 4,638,512 | A | 1/1987 | Frankel | |
| 4,642,817 | A | 2/1987 | Ferstenfeld | |
| 5,175,887 | A | 1/1993 | Kim | |
| 5,313,668 | A | 5/1994 | Bogan et al. | |
| 5,377,360 | A | 1/1995 | Fleitman et al. | |
| 5,432,955 | A | 7/1995 | Plotka et al. | |
| 5,652,959 | A | 8/1997 | Proctor | |
| 5,781,932 | A | 7/1998 | Brown | |

(Continued)

FOREIGN PATENT DOCUMENTS

| | | |
|---|---|---|
| CA | 2625704 | 4/2007 |
| CN | 201451499 | 5/2010 |

(Continued)

OTHER PUBLICATIONS https://www.sweatgutr.com/sweatbands.

*Primary Examiner* — Tajash D Patel
(74) *Attorney, Agent, or Firm* — Norton Rose Fulbright Canada

(57) ABSTRACT

A helmet includes a helmet body, and a sweat-collecting strap extending between opposed ends along an interior of the helmet body. The sweat-collecting strap has a gutter between the opposed ends thereof. Each end of the sweat-collecting strap is mounted along one of the side portions of the helmet body. The sweat-collecting strap is displaceable with respect to the helmet body to bias the gutter against a forehead of the wearer above the eyes.

39 Claims, 4 Drawing Sheets

(56) References Cited

U.S. PATENT DOCUMENTS

| | | | | |
|---|---|---|---|---|
| 5,920,910 | A | 7/1999 | Calvo et al. | |
| 6,108,818 | A | 8/2000 | Eisenberg | |
| 6,675,395 | B1 | 1/2004 | Abraham | |
| D493,026 | S | 7/2004 | Park | |
| 6,978,487 | B2 | 12/2005 | Abraham | |
| 7,140,047 | B2 | 11/2006 | Kronenberger | |
| 7,234,174 | B2 | 6/2007 | Abraham | |
| 7,278,172 | B2 | 10/2007 | Shin | |
| 7,681,252 | B1 * | 3/2010 | Petry | A42C 5/02 2/174 |
| 7,941,870 | B2 | 5/2011 | Kingto | |
| 8,296,866 | B2 | 10/2012 | Kelly | |
| 8,393,014 | B1 | 3/2013 | Follo | |
| D684,175 | S | 6/2013 | Talbot et al. | |
| 8,573,773 | B1 | 11/2013 | Acosta | |
| 8,850,617 | B2 | 10/2014 | Higgins | |
| 9,009,869 | B1 * | 4/2015 | Shapiro | A41D 27/00 2/181 |
| D730,630 | S | 6/2015 | Duff | |
| 9,095,183 | B2 | 8/2015 | Aronson | |
| 2001/0047536 | A1 | 12/2001 | Flatt | |
| 2002/0095714 | A1 | 7/2002 | Vernon | |
| 2002/0129831 | A1 | 9/2002 | Kelly | |
| 2007/0079423 | A1 * | 4/2007 | Flatt | A41D 20/00 2/181.6 |
| 2011/0191939 | A1 | 8/2011 | Jiang Su | |
| 2013/0145518 | A1 | 6/2013 | Decet | |
| 2015/0143615 | A1 * | 5/2015 | LePage | A41D 20/00 2/209.3 |
| 2016/0029722 | A1 | 2/2016 | Klopper | |
| 2018/0303190 | A1 * | 10/2018 | Calilung | A42B 3/28 |

FOREIGN PATENT DOCUMENTS

| | | |
|---|---|---|
| CN | 101822442 | 9/2010 |
| CN | 201631395 | 11/2010 |
| EP | 1931439 | 6/2008 |
| GB | 161499 | 4/1921 |
| GB | 2228181 | 8/1990 |
| WO | 2005025350 | 3/2005 |

* cited by examiner

HELMET WITH SWEAT GUTTER

TECHNICAL FIELD

The application relates generally to protective helmets and, more particularly, to helmets for wearers that sweat.

BACKGROUND

A wearer of a protective helmet can sweat when using the helmet. When a sufficient volume of sweat has accumulated, it can pour down from the wearer's brow and enter the wearer's eyes or flow along the wearer's face, which may distract the wearer or hinder their performance. Conventional helmets do not absorb, divert, or otherwise address the problems caused by sweat.

SUMMARY

There is accordingly provided, in accordance with a first aspect, a helmet, comprising: a helmet body having a front portion, a rear portion, and two side portions to each cover a respective front, rear, and sides of a head of a wearer; and a sweat diversion assembly, comprising: a sweat-collecting strap extending between opposed ends along an interior of the helmet body, the sweat-collecting strap having a gutter between the opposed ends thereof, each end of the sweat-collecting strap being mounted along one of the side portions of the helmet body, the sweat-collecting strap being displaceable with respect to the helmet body; and a biasing member mounted to the interior of the helmet body and to the sweat-collecting strap, and operable to displace the sweat-collecting strap and bias the gutter against a forehead of the wearer above the eyes.

There is also provided, in accordance with a second aspect of the present disclosure, a helmet, comprising: a helmet body having a front portion, a rear portion, and two side portions to each cover a respective front, rear, and sides of a head of a wearer; and a sweat-collecting strap extending between opposed ends along an interior of the helmet body, the sweat-collecting strap having a gutter between the opposed ends thereof, each end of the sweat-collecting strap being mounted along one of the side portions of the helmet body, the sweat-collecting strap being displaceable with respect to the helmet body to bias the gutter against a forehead of the wearer above the eyes.

There is further provided a method of placing a helmet on a head of a wearer, the method comprising: mounting the helmet on the head of the wearer, the helmet having a sweat-collecting strap with a gutter; and biasing the gutter against a forehead of the wearer above the eyes.

In the method as defined above, biasing the gutter may include resiliently compressing the gutter against the forehead of the wearer above the eyes along a front portion of the helmet.

In the method as defined above, biasing the gutter may include resiliently stretching the sweat-collecting strap between side portions of the helmet.

In the method as defined above, biasing the gutter may include adjusting an adjustment strap attached to the helmet and to the sweat-collecting strap to modify a fit of the helmet on the head of the wearer.

In the method as defined above, adjusting the adjustment strap may include adjusting an effective length of the adjustment strap.

BRIEF DESCRIPTION OF THE DRAWINGS

Reference is now made to the accompanying figures in which.

DETAILED DESCRIPTION

Figure 1A:
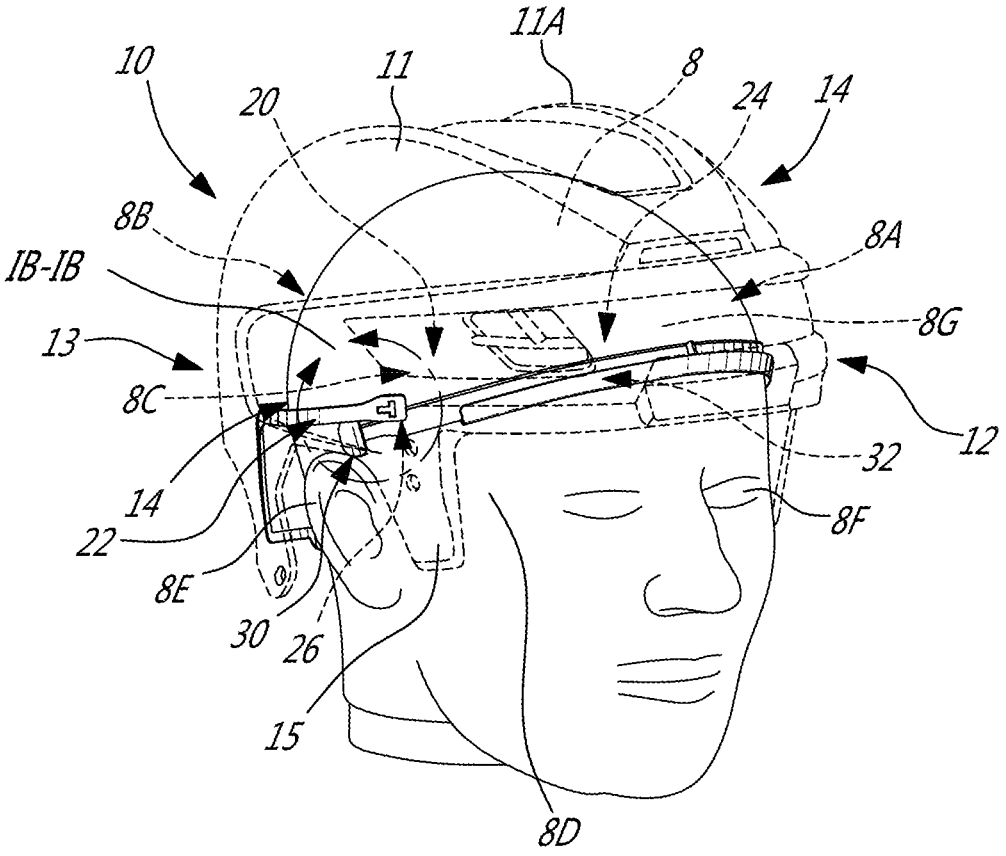
FIG. 1A is a schematic tridimensional view of a helmet having a sweat diversion assembly, according to an embodiment of the present disclosure.

Referring to FIG. 1A, a protective hockey helmet is generally shown at 10. Although the helmet 10 is shown and described as a hockey helmet, it is understood that the helmet 10 can alternately be any other type of protective helmet 10, including but not limited to a lacrosse helmet, a baseball helmet, a football helmet, and a military helmet.

In the embodiment shown, the helmet 10 has a helmet body 11 which covers some or all of the head 8 of the wearer when the helmet 10 is worn. The helmet body 11 includes a hard outer shell 11A. The internal surfaces of the outer shell 11A may include or be overlaid with an inner layer of padding or protective material. The helmet body 11 has a front portion 12 configured to cover and protect a corresponding front portion 8A of the head 8 of the wearer, and a rear portion 13 configured to cover and protect a corresponding rear portion 8B of the head 8. The helmet body 11 also has two side portions 14 configured to cover and protect corresponding side portions 8C of the head 8. In the embodiment shown, each side portion 14 includes a side flap 15, which extends downwardly to protect an area of the side portion 8C of the head 8 between the temple 8D and the ear 8E. More particularly, the side flap 15 extends downwardly from each side portion 14 in front of the ear 8E while leaving the ear 8E uncovered. Other configurations are also possible. The helmet 10 is shown without a visor and a chin strap in order to better illustrate the features of the helmet 10, but it will be appreciated that the helmet 10 may include these features.

Figure 1B:
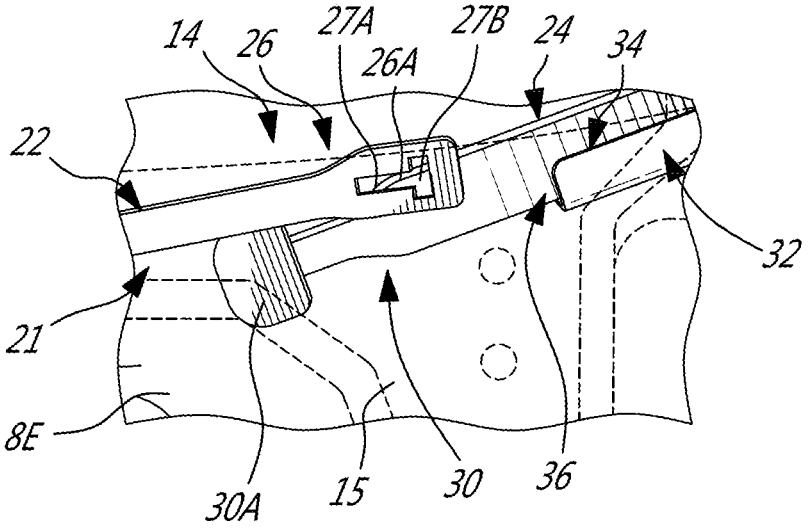
FIG. 1B is an enlarged view of the circled portion IB-IB of FIG. 1A.
Figure 1C:
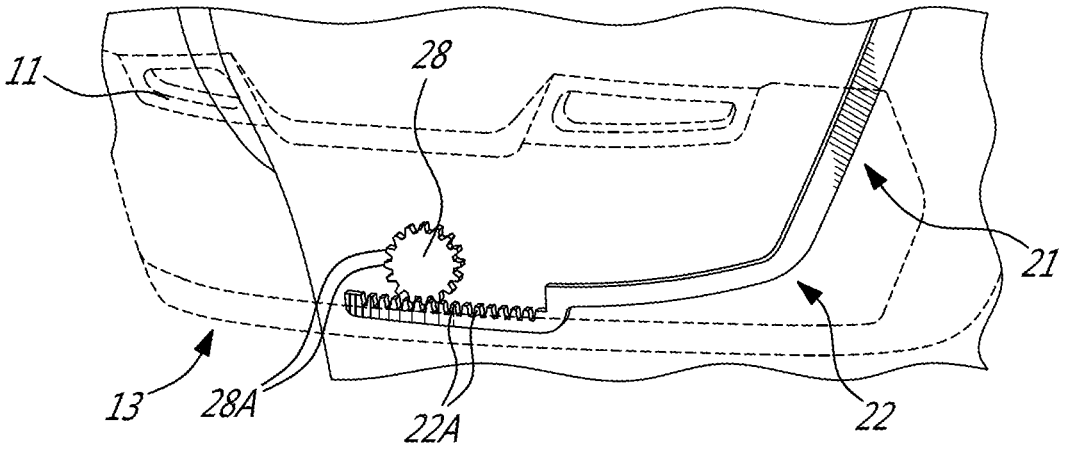
FIG. 1C is an enlarged tridimensional view of a rear portion of the helmet of FIG. 1A.

Referring to FIGS. 1A and 1B, the helmet 10 also includes a sweat diversion assembly 20. The sweat diversion assembly 20 is a collection of components which cooperate together to divert sweat generated by the head 8 away from areas of the face of the wearer where sweat might cause a distraction or affect performance, such as the eyes 8F of the wearer. Many configurations of the sweat diversion assembly 20 are possible to achieve such functionality.

The configuration of the sweat diversion assembly 20 shown in FIGS. 1A and 1B includes an adjustment strap 22 which is mounted to the helmet body 11, and also includes a sweat-collecting strap 24 which is connected to the adjustment strap 22. In the depicted embodiment, the adjustment strap 22 and the sweat-collecting strap 24 are separate components. The adjustment and sweat-collecting straps 22,24 are connected together so that tightening or loosening of the adjustment strap 22 also causes tightening or loosening of the sweat-collecting strap 24, as described in greater detail below. The adjustment strap 22 remains attached to the helmet body 11 when the sweat-collecting strap 24 is disconnected from the adjustment strap 22. In an alternate embodiment, the adjustment and sweat-collecting straps 22,24 are segments of a single, unitary strap. It will therefore be appreciated that the sweat diversion assembly 20 shown in FIGS. 1A and 1B is a collection of components which cooperate together to provide the following two functions: to adjust the helmet body 11 to fit the head 8 of the wearer, and to divert sweat generated by the head 8 away from areas of the face of the wearer where sweat might cause a distraction or affect performance, such as the eyes 8F of the wearer. Thus the sweat diversion assembly 20 shown in FIGS. 1A and 1B acts as a sweat collection apparatus and a helmet adjustment mechanism.

Referring to FIGS. 1A to 10, the adjustment strap 22 either abuts directly against the head 8 of the wearer, or acts on other components which abut against the head 8 of the wearer, to adjust the fit of the helmet body 11 on the head 8. The adjustment strap 22 is mounted to the rear portion 13 of the helmet body 11 and extends along an interior of the helmet body 11. The adjustment strap 22 extends along an interior of the rear and side portions 13,14 of the helmet body 11 between opposite distal ends 26 of the adjustment strap 22. Each distal end 26 of the adjustment strap 22 is connected to a corresponding end of the sweat-collecting strap 24, as described in greater detail below. In the depicted embodiment, and as shown in FIG. 10, the adjustment strap 22 is mounted to the helmet body 11 via a rotatable knob 28 or micro-dial. In the depicted embodiment, the adjustment strap 22 only attached to the helmet body 11 via the knob 28. The knob 28 is mounted to the rear portion 13 of the helmet body 11, and engages the adjustment strap 22 along the rear portion 13. This engagement in the depicted embodiment takes the form of knob teeth 28A of the knob 28 which engage grooves 22A along the adjustment strap 22, similar to a rack-and-pinion engagement. In the depicted embodiment, the adjustment strap 22 is made up of two portions. Each portion of the adjustment strap 22 extends from one of its ends engaged with the knob 28 to another one of its ends which forms one of the distal ends 26 of the adjustment strap 22. Other configurations for engagement between the adjustment strap 22 and the knob 28 are possible. For example, in an alternate embodiment, the adjustment strap 22 is a single strap, and may be used as part of an adjustment system having a wire and a knob.

In the depicted embodiment, rotation of the knob 28 by the wearer will transform the rotational motion of the knob 28 into a linear displacement of the one or both portions of the adjustment strap 22 relative to the knob 28. As one or both portions of the adjustment strap 22 is/are displaced relative to the knob 28 and relative to each other, an effective length of the adjustment strap 22 will vary. This in turns causes the distal ends 26 of the adjustment strap 22 to displace, thereby tightening or loosening the adjustment strap 22 about the head 8 of the wearer. The fit of the adjustment strap 22 about the head 8 of the wearer is therefore adjustable. Other configurations for adjusting, e.g. tightening or loosening, the adjustment strap 22 are also within the scope of the present disclosure.

Referring to FIGS. 1A and 1B, the sweat-collecting strap 24 extends along the interior of the helmet body 11 and diverts sweat generated by the head 8 away from the eyes 8F or other sensitive areas of the face of the wearer. The sweat-collecting strap 24 extends between opposite ends 30. Each end 30 of the sweat-collecting strap 24 is connected to a corresponding distal end 26 of the adjustment strap 24. Each end 30 of the sweat-collecting strap 24 is thus mounted along one of the side portions 8C of the helmet body 11. The configuration of this mounting can vary, such that the sweat-collecting strap 24 is mounted directly to the helmet body 11 at the side portions 8C, or is mounted to another component at the side portions 8C. Some possible configurations are described in greater detail below. The ends 30 of the sweat-collecting strap 24 and the ends 26 of the adjustment strap 22 are connected along each of the side portions 14 of the helmet body 11.

FIG. 1B shows one of the ends 30 of the sweat-collecting strap 24 and one of the ends 26 of the adjustment strap 22 being disconnected for clarity, and to facilitate the description of their components. Each distal end 26 of the adjustment strap 22 includes a slot 26A, and each end 30 of the sweat-collecting strap 24 includes a tab 30A. Each tab 30A is inserted into one of the slots 26A to removably connect the adjustment strap 22 to the sweat-collecting strap 24. The slots 26A in the depicted embodiment are T-shaped. Each T-shaped slot 26A has an elongated parallel portion 27A which is parallel to a direction of the length of the adjustment strap 22, and a transverse portion 27B which is transverse to the parallel portion 27A and to the direction of the length of the adjustment strap 22. Each tab 30A is inserted such that a thin edge of the tab 30A is placed through the parallel and transverse portions 27A,27B. Once inserted through the slot 26A, the tab 30A is twisted to prevent it from being easily removed through the slot 26A.

Referring to FIGS. 1A and 1B, the sweat-collecting strap 24 has a gutter 32 located on the sweat-collecting strap 24 between its opposite ends 30. The gutter 32 is positioned within the interior of the helmet body 11 along the front portion 12 so that it can abut directly against the forehead 8G of the wearer above the eyes 8F. In this position, the gutter 32 is able to intercept the sweat generated by the head 8 before it flows into the eyes 8F, and to divert the sweat away from the eyes 8F. In the configuration shown in FIGS. 1A and 1B, the sweat-collecting strap 24 is mounted indirectly to the helmet body 11 via the adjustment strap 22. The gutter 32 is thus free of direct attachment or connection to the helmet body 11. The gutter 32 is only attached to the helmet body 11 via the adjustment strap 22, through the connection of the ends 30 of the sweat-collecting strap 24 and the distal ends 26 of the adjustment strap 22. The gutter 32 has no other attachment to the helmet body 11. The sweat-collecting strap 24 and thus its gutter 32 is free to move with respect to the helmet body 11 so that its position against the forehead 8G can be adjusted as desired by the wearer. When the wearer adjusts the length of the adjustment strap 22 to tighten or loosen the fit of the helmet body 11, such as by rotating the knob 28 for example, the abutment of the gutter 32 against the forehead 8G of the wearer is also adjusted. Stated differently, the wearer is able to loosen or tighten the gutter 32 against the forehead 8G of the wearer by tightening or loosening the adjustment strap 22. The tightening and loosening of the gutter 32 against the forehead 8G of the wearer also helps to adjust the fit of the helmet body 11 on the head 8. In the depicted embodiment, the sweat diversion assembly 20 is therefore the only component of the helmet 10 which allows the wearer to adjust the size or fit of the helmet 10 on the head 8. The combined functionality of the adjustment strap 22 and the sweat-collecting strap 24 in the configuration shown in FIGS. 1A and 1B provides the only adjustment of the fit of the helmet body 11, and also helps to divert sweat away from the face of the wearer.

The adjustment strap 22 therefore forms, or is part of, a biasing member 21 of the helmet 10 which functions to displace the sweat-collecting strap 24 and bias the gutter 32 against the forehead 8G of the wearer above the eyes 8F. More particularly, as the wearer tightens the adjustment strap 22, the wearer biases the gutter 32 against the forehead 8G of the wearer. The gutter 32 is thus attached to the helmet body 11 in such a way that the gutter 32 may be biased against the forehead. The biasing member 21 includes, or is, any suitable component which operates to displace the sweat-collecting strap 24 against the forehead 8G. Other configurations of the biasing member 21 are therefore possible, and examples of other possible configurations for the biasing member 21 are described in greater detail below.

The features of the gutter 32 are now described in greater detail with reference to FIG. 2. The gutter 32 is a shallow trough or furrow which collects and diverts sweat. The gutter 32 is sufficiently flexible to conform to the contour of the forehead 8G. The gutter 32 has three interconnected walls: an inner gutter wall 33A, an outer gutter wall 33B, and a bottom gutter wall 33C. The inner gutter wall 33A is configured for abutting against the forehead 8G of the wearer. The outer gutter wall 33B is spaced apart from the inner gutter wall 33A by the bottom gutter wall 33C, which also interconnects the inner and outer gutter walls 33A,33B. Sweat from the wearer's forehead 8G typically enters the gutter 32 by flowing down along the inner gutter wall 33A and pooling along the bottom gutter wall 33C. The outer gutter wall 33B prevents the sweat pooled along the bottom gutter wall 33C from spilling over. It will therefore be appreciated that, collectively, the inner, outer, and bottom gutter walls 33A,33B,33C define a channel 34 of the gutter 32 which collects the sweat and diverts it away from the eyes 8F. The gutter walls 33A,33B,33C are impermeable to fluids, such that sweat cannot flow through the gutter walls 33A,33B,33C. The gutter walls 33A,33B,33C are made from any suitable material which provides such impermeability. Some examples of suitable materials include, but are not limited to, silicone, thermoplastic urethane (TPU), and other elastomeric materials.

Figure 2:
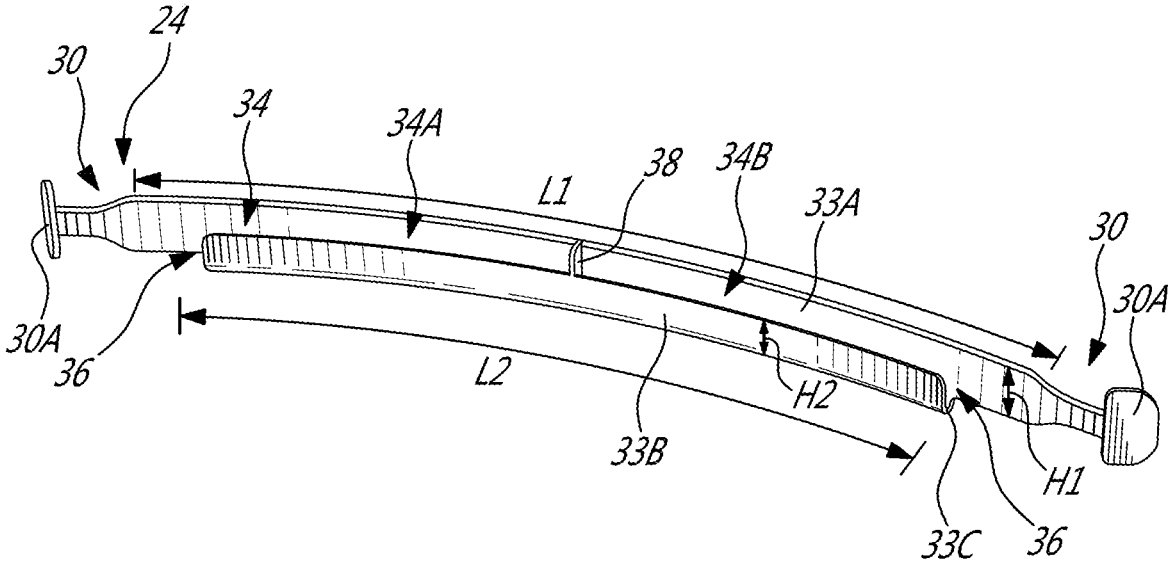
FIG. 2 is a schematic tridimensional view of a sweat-collecting strap of the sweat diversion assembly of FIG. 1A.

In FIG. 2, the inner gutter wall 33A has a height H1 that is greater than a height H2 of the outer gutter wall 33B. The taller inner gutter wall 33A may help to draw more sweat into the channel 34 by providing a greater surface area in contact with the forehead 8G. A length L2 of the outer gutter wall 33B is less than a length L1 of the inner gutter wall 33A. In an alternate embodiment, the length L2 of the outer gutter wall 33B is equal to or greater than the length L1 of the inner gutter wall 33A. The channel 34 is not enclosed or bounded by an end wall extending between the inner and outer gutter walls 33A,33B, and therefore the channel 34 has open ends 36 on opposite sides of the channel 34. Each of the open ends 36 of the channel 34 is positioned to the side of the wearer's face, along one of the side portions 14 of the helmet body 11, in order to divert sweat away from the eyes 8F and towards the side of the head 8 (see FIG. 1B). In FIG. 1B, each of the open ends 36 of the channel 34 is positioned to divert sweat along the side of the head 8 forward of the ears 8E. Each of the open ends 36 of the channel 34 is positioned to divert sweat along the side of the head 8 between the ears 8E and the temple 8D. Still referring to FIG. 1B, each of the open ends 36 of the channel 34 is positioned to divert sweat along the side flap 15 of the helmet body 11.

Referring back to FIG. 2, the gutter 32 includes a gutter barrier 38 disposed in the channel 34. The gutter barrier 38 extends between the inner and outer gutter walls 33A,33B to block the channel 34. The gutter barrier 38 therefore divides the channel 34 into first and second channel segments 34A,34B, which are prevented from being in fluid flow communication by the gutter barrier 38. Sweat may pool in the smaller-volume first and second channel segments 34A, 34B to more easily reach the minimum volume needed to overcome the friction of the gutter walls 33A,33B,33C and flow out of the open ends 36 of the channel 34, as compared to a similar channel 34 without a gutter barrier 38. The gutter barrier 38 may also reinforce the inner and outer gutter walls 33A,33B. In an alternate embodiment, the gutter 32 is free of the gutter barrier 38 or other objects which obstruct the flow of fluid along the channel 34.

Figure 3A:
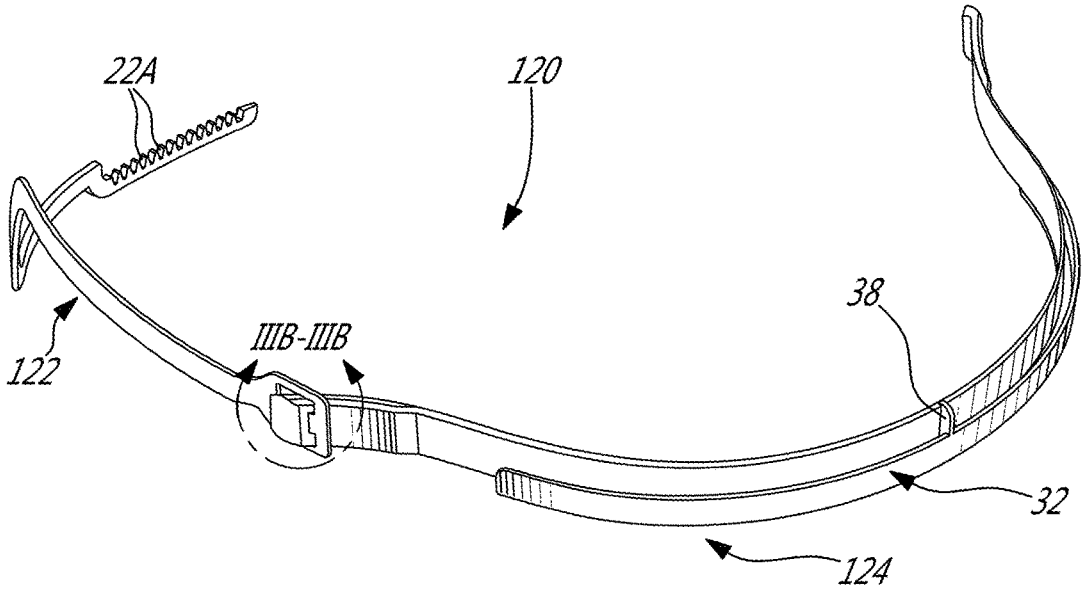
FIG. 3A is a schematic tridimensional view of a sweat diversion assembly, according to another embodiment of the present disclosure.
Figure 3B:
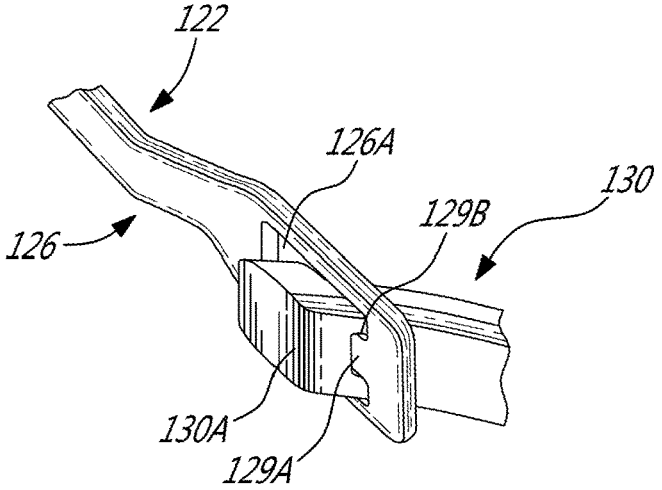
FIG. 3B is an enlarged tridimensional view of the circled portion IIIB-IIIB of FIG. 3A.
Figure 3C:
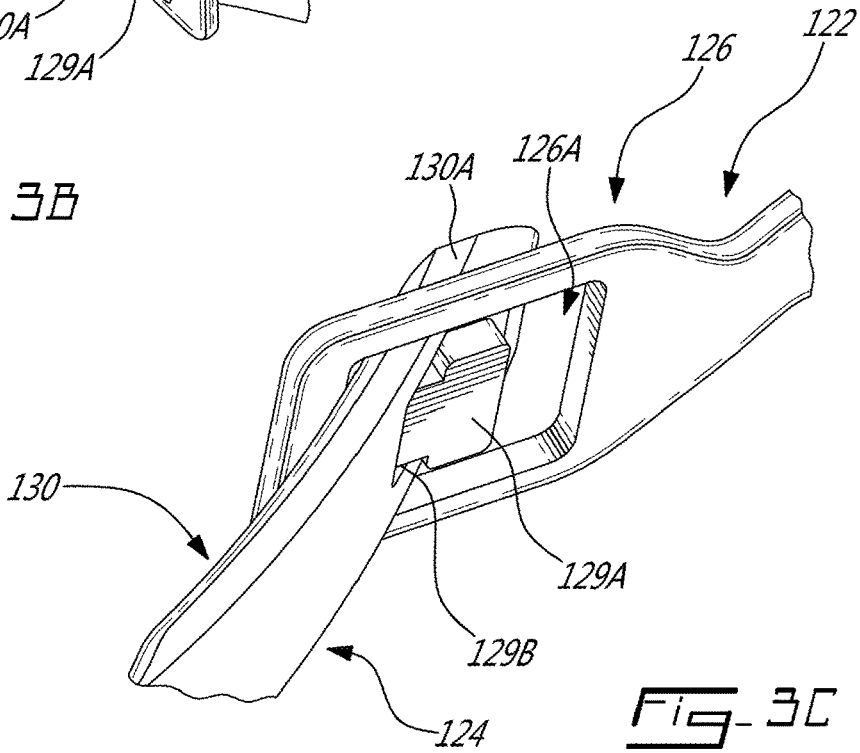
FIG. 3C is another tridimensional view of the circled portion IIIB-IIIB of FIG. 3A, taken in a direction opposite that of FIG. 3B.

Another possible configuration for connecting the adjustment and sweat-collecting straps 122,124 is shown in FIGS. 3A to 3C. In the depicted embodiment of the sweat diversion assembly 120, the adjustment strap 122 and the sweat-collecting strap 124 are similar to the adjustment and sweat-collecting straps 22,24 described above, the principal difference being in how the adjustment and sweat-collecting straps 122,124 connect to one another. Each distal end 126 of the adjustment strap 122 includes a slot 126A, and each end 130 of the sweat-collecting strap 124 includes a tab 130A. In the depicted embodiment, each slot 126A includes an attachment projection 129A disposed in each slot 126A, and each tab 130A includes an aperture 129B. The sweat-collecting strap 124 is made of a resilient material, and the ends 130 are elastically deformable. To removably connect the adjustment and sweat-collecting straps 122,124 together, each end 130 of the sweat-collecting strap 124 is elastically deformed by the wearer to stretch the aperture 129B such that it can be fitted over the attachment projection 129A, which is inserted through the aperture 129B. When the wearer releases the end 130 of the sweat-collecting strap 124, the aperture 129B returns to its default size which is too small to permit the attachment projection 129A from being pulled through the aperture 129B. The attachment projections 129A in the depicted embodiment are T-shaped.

The adjustment strap 22,122 and the sweat-collecting strap 24,124 can be made of any suitable material. In an embodiment, the adjustment strap 22,122 is made from a material that is less elastically deformable than the material of the sweat-collecting strap 24,124. For example, the adjustment strap 22,122 may be made from a thermoplastic material such as nylon or acrylonitrile butadiene styrene (ABS), while the sweat-collecting strap 24,124 may be made from an elastomeric material, such as polyurethane.

Figure 4:
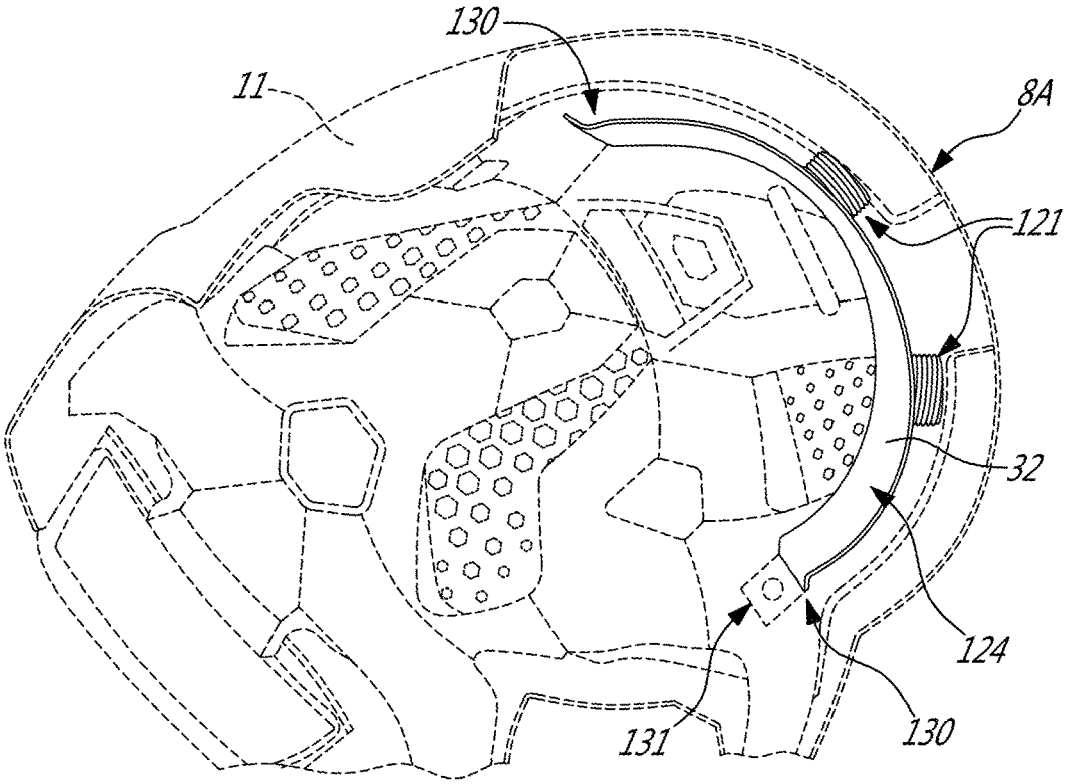
FIG. 4 is a schematic tridimensional view of a helmet having a sweat diversion assembly, according to another embodiment of the present disclosure.
Figure 5:
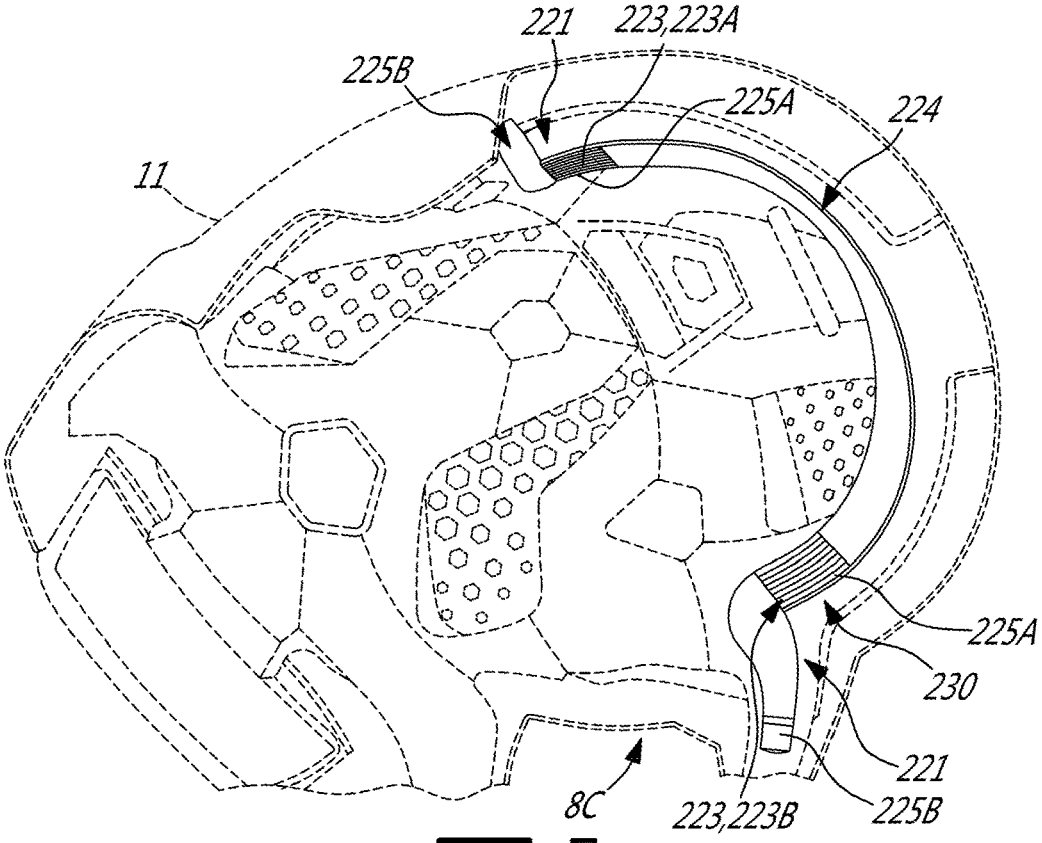
FIG. 5 is a schematic tridimensional view of a helmet having a sweat diversion assembly, according to another embodiment of the present disclosure.

Other configurations of the biasing member 21 are now described with reference to FIGS. 4 and 5. In FIGS. 4 and 5, components similar to those described above are designated with the same reference numbers, it being appreciated that the description and functionality of the components described above apply mutatis mutandis to the components in FIGS. 4 and 5.

In FIG. 4, the sweat-collecting strap 124 is attached directly to the helmet body 11. The ends 130 of the sweat-collecting strap 124 have attachments 131 which attach to temple portions of the helmet body 11. The biasing member 121 extends between the interior of the helmet body 11 and the gutter 32, and is attached to both the helmet body 11 and the gutter 32. FIG. 4 shows multiple biasing members 121 mounted along the interior of the front portion 8A of the helmet body 11 and spaced apart along the front portion 8A. In the configuration shown in FIG. 4, the gutter 32 is attached to the helmet body 11 such that it is biased against the forehead 8G when the helmet 10 is worn by the wearer. In FIG. 4, the biasing members 121 are in the form of a resiliently compressible foam which is compressed when the forehead 8G of the wearer pushes the gutter 32 against the biasing members 121. The resiliently compressible foam biasing members 121 expand outwardly from the interior of the front portion 8A and displace the gutter 32 toward the interior of the helmet body 11 when the head 8 of the wearer is removed from the helmet 10. Thus, in FIG. 4, adjustment of the gutter 32 is created with the compression of the resiliently compressible foam biasing members 121.

In FIG. 5, the sweat-collecting strap 224 is attached directly to the helmet body 11. The biasing member 221 includes one or more elastic members 223 mounted to each of the ends 230 of the sweat-collecting strap 224 and to the interior of the helmet body 11 along each side portions 8C. In the configuration shown in FIG. 5, a first elastic member 223A is mounted to one of the ends 230 of the sweat-collecting strap 224 and to the interior of the helmet body 11 along one of the side portions 8C, and a second elastic member 223B is mounted to the other of the ends 230 of the sweat-collecting strap 224 and to the interior of the helmet body 11 along the other of the side portions 8C. The elastic members 223A,223B experience elastic deformation when the head 8 of the wearer is placed within the helmet 10 and against the sweat-collecting strap 224. The deformation of the elastic member 223A,223B causes them to apply tension to the sweat-collecting strap 224 and its gutter 32, thereby biasing the gutter 32 against the forehead 8G. Thus, in FIG. 5, adjustment of the gutter 32 is created with the elastic tension of the elastic members 223A,223B. In the configuration shown in FIG. 5, each elastic member 223A,223B includes an elastically deformable portion 225A and an attachment portion 225B. The elastically deformable portions 225A are attached to the ends 230 of the sweat-collecting strap 224, and the attachment portions 225B are attached to temple portions of the helmet body 11. The attachment portions 225B are rigid or not elastically deformable. The attachment portions 225B are less elastically deformable than the elastically deformable portions 225A. In an alternate embodiment, the biasing member 221 has only one elastic member 223. In alternate embodiment, the elastic member 223 is, or results from, the material composition of the sweat-collecting strap 224 which allows for elastic deformation.

In use and in a particular embodiment, the fit of the helmet 10 on the head 8 of the wearer is adjusted by mounting the helmet 10 on the head 8 of the wearer, and adjusting the adjustment strap 22,122 to modify the fit of the helmet 10 on the head 8 of the wearer. Adjusting the adjustment strap 22,122 also adjusts the gutter 24,124 against the forehead 8G of the wearer.

In use and in a particular embodiment, the helmet 10 is placed on the head of the wearer by mounting the helmet 10 on the head 8, and biasing the gutter 32 against the forehead 8G above the eyes 8F.

The above description is meant to be exemplary only, and one skilled in the art will recognize that changes may be made to the embodiments described without departing from the scope of the invention disclosed. For example, although the word "strap" is used herein, it will be appreciated that any elongated tie, band, belt, or other similar object can be used for the adjustment strap 22,122 and the sweat-collecting strap 24,124. Still other modifications which fall within the scope of the present invention will be apparent to those skilled in the art, in light of a review of this disclosure, and such modifications are intended to fall within the appended claims.

The invention claimed is:

1. A helmet, comprising:

a helmet body having a front portion, a rear portion, and two side portions to each cover a respective front, rear, and sides of a head of a wearer; and a sweat diversion assembly, comprising:

a sweat-collecting strap extending between opposed ends along an interior of the helmet body, the sweat-collecting strap having a gutter between the opposed ends thereof, each end of the sweat-collecting strap being mounted along one of the side portions of the helmet body, the sweat-collecting strap being displaceable with respect to the helmet body; and a biasing member mounted to the interior of the helmet body and to the sweat-collecting strap, and operable to displace the sweat-collecting strap and bias the gutter against a forehead of the wearer above the eyes.

2. The helmet as defined in claim 1, wherein the biasing member extends between the interior of the helmet body and the gutter.

3. The helmet as defined in claim 2, wherein the biasing member includes multiple biasing members mounted along the front portion of the helmet body and spaced apart therealong.

4. The helmet as defined in claim 2, wherein the biasing member includes a resiliently compressible foam.

5. The helmet as defined in claim 1, wherein the biasing member includes at least one elastic member mounted to at least one of the ends of the sweat-collecting strap and to the interior of the helmet body along at least one of the side portions.

6. The helmet as defined in claim 5, wherein the at least one elastic member includes a first elastic member mounted to one of the ends of the sweat-collecting strap and to the interior of the helmet body along one of the side portions, and a second elastic member mounted to the other of the ends of the sweat-collecting strap and to the interior of the helmet body along the other of the side portions.

7. The helmet as defined in claim 1, wherein the biasing member includes an adjustment strap mounted to the helmet body and extending between distal ends disposed along the side portions of the helmet body, the adjustment strap being adjustable to adjust a fit of the helmet body on the head of the wearer, each end of the sweat-collecting strap being connected to one of the distal ends of the adjustment strap along one of the side portions of the helmet body such that adjusting the adjustment strap also biases the gutter against the forehead of the wearer.

8. The helmet as defined in claim 7, wherein the sweat-collecting strap is mounted indirectly to the helmet body via the adjustment strap.

9. The helmet as defined in claim 7, wherein the adjustment strap includes two portions, and the adjustment strap is adjustable by changing a relative position of the two portions so as to adjust an effective length of the adjustment strap.

10. The helmet as defined in claim 7, wherein each distal end of the adjustment strap includes a slot, and each end of the sweat-collecting strap includes a tab, each tab being insertable into a corresponding slot to connect the adjustment strap to the sweat-collecting strap.

11. The helmet as defined in claim 10, wherein the slot is T-shaped.

12. The helmet as defined in claim 10, wherein each slot of the adjustment strap includes an attachment projection disposed in each slot, and each tab of the sweat-collecting strap includes an aperture, each attachment projection being insertable into a corresponding aperture to connect the adjustment strap to the sweat-collecting strap.

13. The helmet as defined in claim 12, wherein the attachment projection is T-shaped.

14. The helmet as defined in claim 7, wherein the sweat diversion assembly includes a rotatable knob mounted to the rear portion of the helmet body, the rotatable knob engaging the adjustment strap along the rear portion of the helmet body to adjust the length of the adjustment strap.

15. The helmet as defined in claim 1, wherein the gutter includes an inner gutter wall being abuttable against the forehead of the wearer, and an outer gutter wall spaced from the inner gutter wall and connected thereto by a bottom gutter wall, the inner, outer, and bottom gutter walls defining a channel of the gutter, the inner gutter wall being having a height greater than a height of the outer gutter wall.

16. The helmet as defined in claim 15, wherein a length of the outer gutter wall is less than a length of the inner gutter wall.

17. The helmet as defined in claim 15, wherein the channel is open at opposite ends thereof, each of the open ends of the channel being disposed along one of the side portions of the helmet body.

18. The helmet as defined in claim 17, wherein each of the open ends is positioned to drain fluid from the channel along a side flap of the helmet body.

19. The helmet as defined in claim 15, wherein the gutter includes a gutter barrier disposed in the channel and extending between the inner and outer gutter walls.

20. A helmet, comprising:

a helmet body having a front portion, a rear portion, and two side portions to each cover a respective front, rear, and sides of a head of a wearer; and a sweat-collecting strap extending between opposed ends along an interior of the helmet body, the sweat-collecting strap having a gutter between the opposed ends thereof, each end of the sweat-collecting strap being mounted along one of the side portions of the helmet body, the sweat-collecting strap being displaceable with respect to the helmet body to bias the gutter against a forehead of the wearer above the eyes.

21. The helmet as defined in claim 20, further comprising a biasing member mounted to the interior of the helmet body and to the sweat-collecting strap, and operable to displace the sweat-collecting strap and bias the gutter against a forehead of the wearer above the eyes.

22. The helmet as defined in claim 21, wherein the biasing member extends between the interior of the helmet body and the gutter.

23. The helmet as defined in claim 22, wherein the biasing member includes multiple biasing members mounted along the front portion of the helmet body and spaced apart therealong.

24. The helmet as defined in claim 22, wherein the biasing member includes a resiliently compressible foam.

25. The helmet as defined in claim 21, wherein the biasing member includes at least one elastic member mounted to at least one of the ends of the sweat-collecting strap and to the interior of the helmet body along at least one of the side portions.

26. The helmet as defined in claim 25, wherein the at least one elastic member includes a first elastic member mounted to one of the ends of the sweat-collecting strap and to the interior of the helmet body along one of the side portions, and a second elastic member mounted to the other of the ends of the sweat-collecting strap and to the interior of the helmet body along the other of the side portions.

27. The helmet as defined in claim 21, wherein the biasing member includes an adjustment strap mounted to the helmet body and extending between distal ends disposed along the side portions of the helmet body, the adjustment strap being adjustable to adjust a fit of the helmet body on the head of the wearer, each end of the sweat-collecting strap being connected to one of the distal ends of the adjustment strap along one of the side portions of the helmet body such that adjusting the adjustment strap also biases the gutter against the forehead of the wearer.

28. The helmet as defined in claim 27, wherein the sweat-collecting strap is mounted indirectly to the helmet body via the adjustment strap.

29. The helmet as defined in claim 27, wherein the adjustment strap includes two portions, and the adjustment strap is adjustable by changing a relative position of the two portions so as to adjust an effective length of the adjustment strap.

30. The helmet as defined in claim 27, wherein each distal end of the adjustment strap includes a slot, and each end of the sweat-collecting strap includes a tab, each tab being insertable into a corresponding slot to connect the adjustment strap to the sweat-collecting strap.

31. The helmet as defined in claim 30, wherein the slot is T-shaped.

32. The helmet as defined in claim 30, wherein each slot of the adjustment strap includes an attachment projection disposed in each slot, and each tab of the sweat-collecting strap includes an aperture, each attachment projection being insertable into a corresponding aperture to connect the adjustment strap to the sweat-collecting strap.

33. The helmet as defined in claim 32, wherein the attachment projection is T-shaped.

34. The helmet as defined in claim 27, wherein the sweat diversion assembly includes a rotatable knob mounted to the rear portion of the helmet body, the rotatable knob engaging the adjustment strap along the rear portion of the helmet body to adjust the length of the adjustment strap.

35. The helmet as defined in claim 20, wherein the gutter includes an inner gutter wall being abuttable against the forehead of the wearer, and an outer gutter wall spaced from the inner gutter wall and connected thereto by a bottom gutter wall, the inner, outer, and bottom gutter walls defining a channel of the gutter, the inner gutter wall being having a height greater than a height of the outer gutter wall.

36. The helmet as defined in claim 35, wherein a length of the outer gutter wall is less than a length of the inner gutter wall.

37. The helmet as defined in claim 35, wherein the channel is open at opposite ends thereof, each of the open ends of the channel being disposed along one of the side portions of the helmet body.

38. The helmet as defined in claim 37, wherein each of the open ends is positioned to drain fluid from the channel along a side flap of the helmet body.

39. The helmet as defined in claim 35, wherein the gutter includes a gutter barrier disposed in the channel and extending between the inner and outer gutter walls.

* * * * *